US005781956A

United States Patent [19]

Kelsay et al.

[11] Patent Number: 5,781,956

[45] Date of Patent: Jul. 21, 1998

[54] PLASTIC MOLDED FLOAT HANDLE

[75] Inventors: Curtis Dwight Kelsay, Springdale, Ark.; Alan Jerome Ness, Edgerton, Kans.

[73] Assignee: Marshalltown Trowel Company, Marshalltown, Iowa

[21] Appl. No.: 588,115

[22] Filed: Jan. 17, 1996

[51] Int. Cl.[6] ..... B05C 17/10

[52] U.S. Cl. ..... 15/143.1; 15/235.4; 16/110 R

[58] Field of Search ..... 15/143.1, 235.4–235.8; 16/110 R, 111 R, 116 R, DIG. 12, DIG. 18, DIG. 19; 81/489

[56] References Cited

U.S. PATENT DOCUMENTS

| | | | |
|---|---|---|---|
| 31,436 | 2/1861 | Bisbee . | |
| 162,355 | 4/1875 | Disston . | |
| 404,667 | 6/1889 | Woodhouse et al. . | |
| 747,036 | 12/1903 | Bishop . | |
| 751,356 | 2/1904 | Smith . | |
| 1,153,575 | 9/1915 | Rowley . | |
| 2,738,042 | 3/1956 | Dalton | 16/111 R |
| 3,302,673 | 2/1967 | Forsberg . | |
| 4,316,302 | 2/1982 | Clark | 15/235.4 |
| 4,381,579 | 5/1983 | Rumpp | 16/111 R |
| 4,467,492 | 8/1984 | Harrington | 15/235.4 |
| 4,639,029 | 1/1987 | Kolonia | 294/57 |
| 4,729,271 | 3/1988 | Kenigson | 81/177.1 |
| 4,739,536 | 4/1988 | Bandera et al. | 16/111 R |
| 4,837,892 | 6/1989 | Lo | 16/DIG. 12 X |
| 4,884,312 | 12/1989 | Clark | 15/235.4 |
| 4,941,232 | 7/1990 | Decker et al. | 16/111 R |
| 5,155,878 | 10/1992 | Dellis | 16/111 R |
| 5,327,612 | 7/1994 | Kelsay | 15/235.4 |

FOREIGN PATENT DOCUMENTS

| | | | |
|---|---|---|---|
| 255137 | 10/1964 | Australia | 15/235.4 |
| 1507629 | 11/1967 | France | 15/235.4 |

*Primary Examiner*—Mark Spisich

*Attorney, Agent, or Firm*—McAndrews, Held, & Malloy, Ltd.

[57] ABSTRACT

A handle for a concrete float comprising a molded outer grip surface shot around a molded plastic core. Two identical components are engaged to form the plastic core. Each component has an interior rib structure and a mounting nose. The mounting nose has a cavity for receiving a screw and a flat mounting surface. The screw passes through the cavity and engages the threaded recesses of the float blade, fastening the handle to the blade.

9 Claims, 3 Drawing Sheets

PLASTIC MOLDED FLOAT HANDLE

BACKGROUND OF THE INVENTION

The present invention relates to a tool handle, and more particularly to handle for a float that is molded from separate shots of two different types of thermoplastic materials. An inner member is injection molded from a suitably rigid thermoplastic material, with appropriate interior rib structures to provide support, rigidity and durability to the handle. An outer member, which constitutes the majority of the outwardly presented surface of the handle, is molded from a second shot of thermoplastic elastomer around the inner member. The thermoplastic elastomer surface has a slightly soft, non-slip, rubber-like feel, which serves to provide favorable gripping characteristics and comfort to the user.

Present concrete floats include a blade with a flat bottom surface, with the blade being constructed out of one of a number of suitable materials, such as aluminum, magnesium, wood or composites. The blade has a handle mounted or attached to it. The handle is typically made of wood, but in recent years some of the handles are made of plastic resin. The wood handles of the prior art are subject to wear and negative effects from the environment that the tools are used. Wood handles absorb moisture, causing the handles to expand and contract due to changes in the environment in which the tool is used. The expansion and contraction that accompanies the absorption or giving up of moisture causes the handles to crack, requiring that the handle be replaced, which results in loss of productivity and additional expense. Furthermore, changes in the operating characteristics of wood handles causes the weight and feel of the float to vary over time. Consequently, the user must adapt to changing tool characteristics over time.

Since the float handle must be durable, plastic molded handles are of a rigid plastic. The stresses applied to the handle during use require rigidity to prevent deformation and failure over extended use periods. Such rigid plastics generally provide a slick outer surface that is undesirable for gripping and tool manipulation. Furthermore, the plastic float handles of the prior art are generally molded from one solid piece of plastic. Such solid molded plastic handles are expensive to manufacture, and must be foam molded to make the plastic molded handle economically feasible.

The connection of present wood float handles to the float blade is often a point of failure. Rigid connection interfaces bear the forces of manipulation of the tool during use. The inability of the interface of a wood handle to accept the applied forces during use often results in the failure of the handle over a period of time. Such failures limit the life of an otherwise useful tool, requiring the tool, or at least the handle, to be replaced. Furthermore, the tendency of wooden handles to expand and contract in response to the variety of environments that floats operate in causes gaps to appear between the mounting portion of the handle and the float blade. Working materials, such as concrete and the like, accumulate in the gaps caused by contraction of the wooden handle. The accumulation of these materials often results in stripping of the threads of the blade and causes the threads of the mounting screws to become worn and stripped. Concrete floats are used with a variety of substances. These substances are wet and often times serve as irritants to the skin. The float is used to smooth surfaces of materials (such as concrete and epoxy type matrixes) while they are still amenable to manipulation to insure that the material sets in a desirable fashion. This often requires that the user must reach out and manipulate the tool at arm's length for long periods of time. A firm and sound grip is important. Since the tool is often used at arms length, it is important that the handle be durable, yet light in weight, and permit a comfortable grip to reduce operator fatigue.

SUMMARY OF THE INVENTION

Therefore, it is an object of the present invention to overcome the deficiencies of prior art floats which use materials that are subject to changes due to the environment such as absorbing moisture while avoiding the problem of slick plastic surfaces that result in deteriorated gripping characteristics, added weight and expensive manufacturing processes.

It is a further object of the invention to provide an improved float.

It is yet another object of the invention to provide a float handle having an inner and an outer surface, with the inner surface being made of a suitably rigid plastic material and the outer member being composed of a softer rubber-like material with favorable gripping characteristics.

It is another object of the invention to provide a material selection for the two elements of the handle that are of the same base carrier resin. This affords both a mechanical and thermal bond between the inner and outer surfaces of the handle.

Another object of the invention is to provide a handle that is light weight, resistant to wear and weather, and that is capable of providing a consistent seal between the handle and tool that prevents the accumulation of materials in the mounting area around the mounting screws that attach the handle to the float blade.

DESCRIPTION OF THE PREFERRED EMBODIMENT

Figure 1:
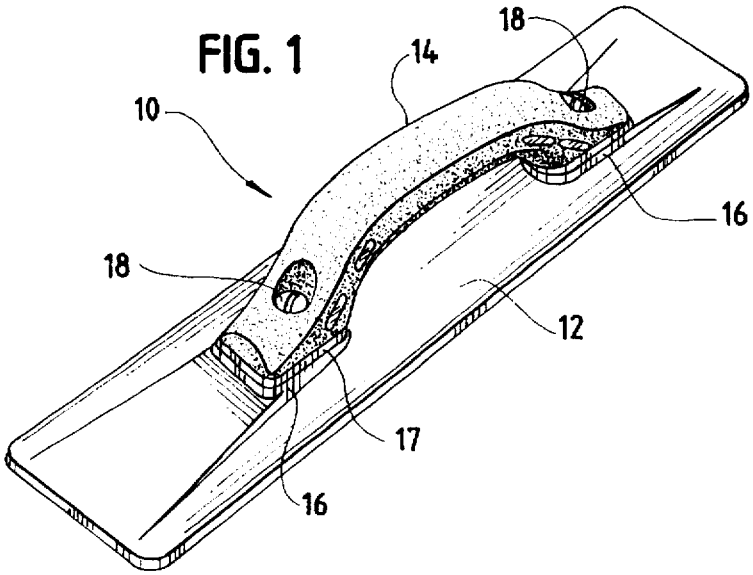
FIG. 1 is a perspective view of an embodiment of a float according to the present invention.

Referring to FIG. 1, a float 10 is constructed from a metal blade 12, preferably made of magnesium, and a handle 14 which is mounted to the blade along blade mounts 16. Mounts 16 are formed integrally with blade 12 and provide a pair of coplanar mounting surfaces 17 against which handle 14 is secured. A pair of screws 18 secure handle 14 to the blade by mating with threaded recesses (not shown) formed in mounts 16.

Figure 2:
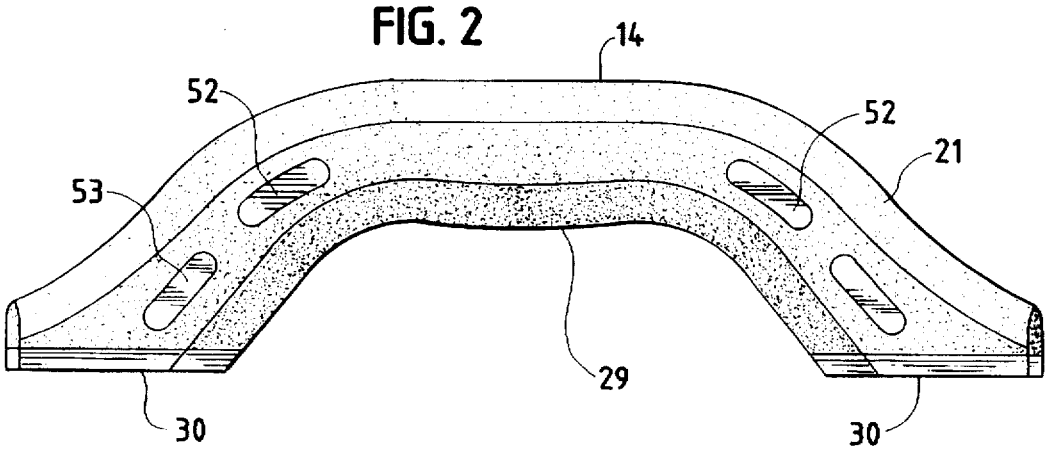
FIG. 2 is a side view of the handle of the float depicted in FIG. 1.
Figure 7:
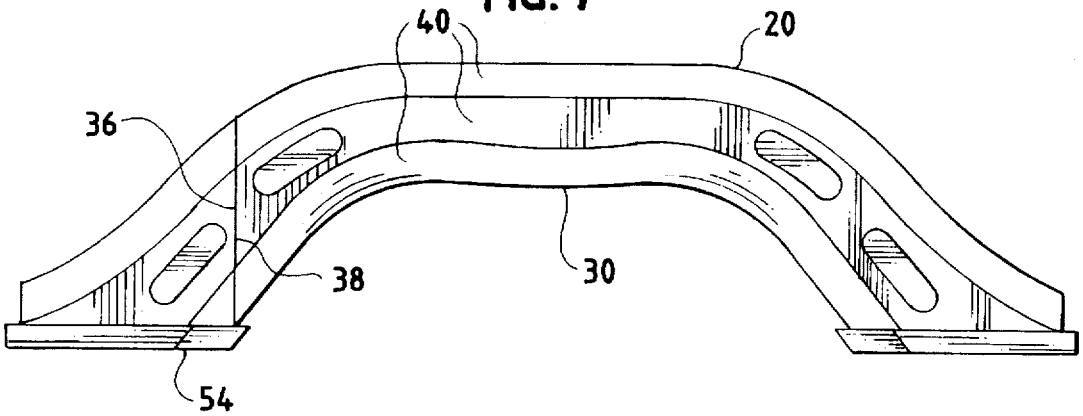
FIG. 7 is a side view of the two core components of FIG. 4 shown in their engaged position.

Referring now to FIGS. 2 and 7, handle 14 is constructed from an outer thermoplastic elastomer layer 21 (FIG. 2) which is molded onto an inner support core 20 (FIG. 7). Core 20 extends throughout the length of the handle providing the primary structural component of the handle, while elastomer layer 21 provides a substantial covering to the core. Core 20 may be formed from a suitable rigid material, such as polypropylene, and may be molded by an injection molding process.

Figure 4:
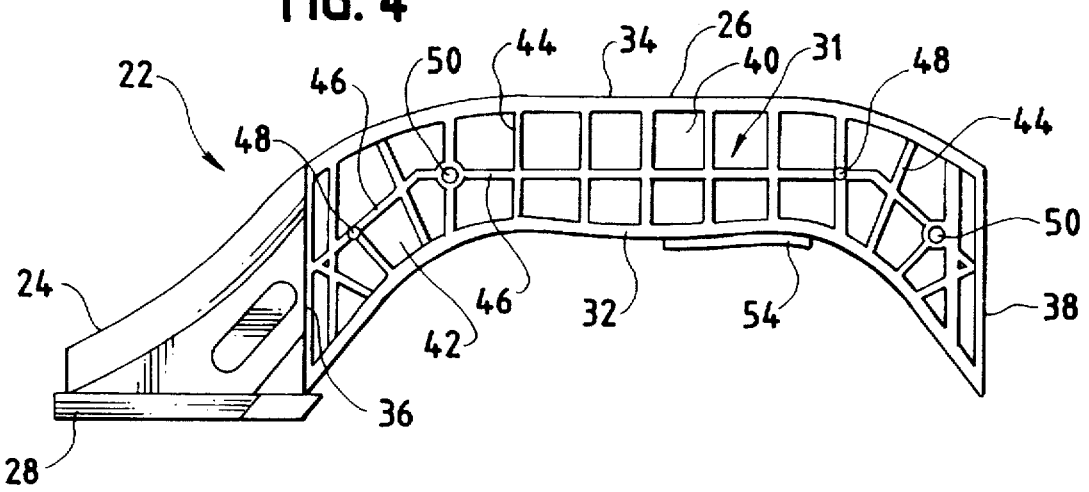
FIG. 4 is side view of one of the two core components that comprise the handle of the float depicted in FIG. 1.
Figure 5:
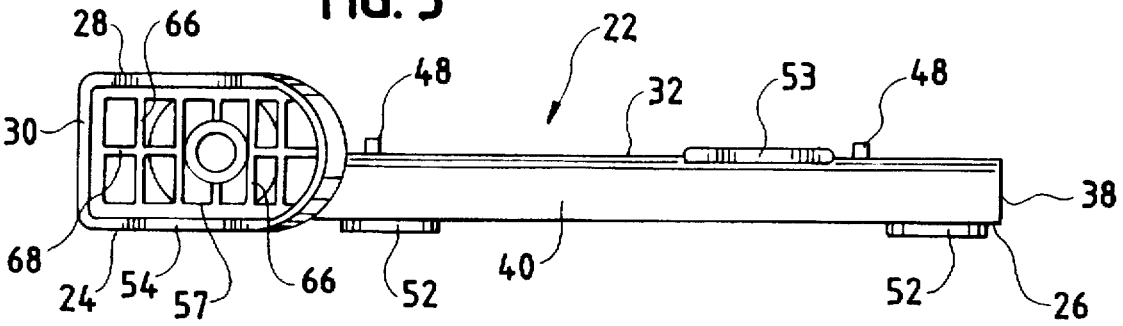
FIG. 5 is a bottom view of the core components depicted in FIG. 4.
Figure 6:
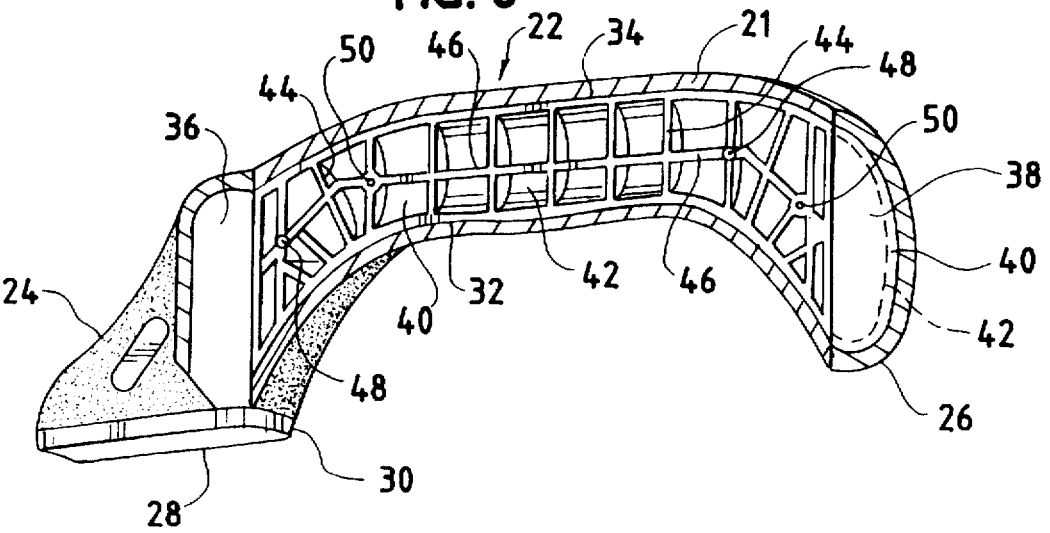
FIG. 6 is a cut-away view of a portion of the handle of FIG. 2, cut along the joining lines of the two core components of FIG. 4.

As shown in FIGS. 4, 5 and 6, core 20 is formed from two identical core components 22 which are fitted or engaged together prior to the molding of outer layer 21. Each core component 22 has a mounting nose 24 and a half grip portion 26.

Mounting nose 24 is comprised of a base section 28 having a flat bottom surface 30 of a size for engagement against one of the flat mounting surfaces 17 of the blade. Half grip portion 26 extends upwardly and laterally from mounting nose 24 to provide a U-shaped grip recess 29 beneath the handle and above the blade to allow space for the user's fingers. Half grip portion 26 is open along one of its sides permitting inspection of its internal ribbed structure 31. Half-grip portion 26 is formed of a curved wall member 40 (FIG. 6) terminating in a lowermost edge surface 32 and an uppermost edge surface 34 at the open side. Edge surfaces 32, 34 are coplanar and define the vertical mating plane of the two core components. Surfaces 32, 34 are configured to mate with the like edge surfaces of the other core component 22.

Core component 22 has a large area engagement surface 36 disposed along the proximal edge of nose 24 and a large area engagement surface 38 disposed along the proximal edge of half grip portion 26. Engagement surfaces 36, 38 are planar in configuration being disposed parallel to one another and substantially perpendicular to the plane of bottom surface 30. While engagement surface 36 extends across the entire proximal side of nose 24, only one-half of the surface is presented for engagement.

Rib structure 31 is formed of a plurality of ribs 44 extend between edges 32, 34 and extending laterally to the inside surface 42 (FIG. 6) of the curved wall member 40. Ribs 44 support and strengthen wall member 40 preventing it from collapsing under compressive forces applied during tool manufacture and use. A center rib 46 is disposed between edges 32 and 34, providing additional support. Rib 46 likewise extends laterally to inside surface 42 of the curved wall member.

A pair of male bosses 48 and a pair of female recesses 50 are located along center rib 46 and are arranged for mating with a counterpart boss or recess in the other core component when the two core components are mated together.

Figure 3:
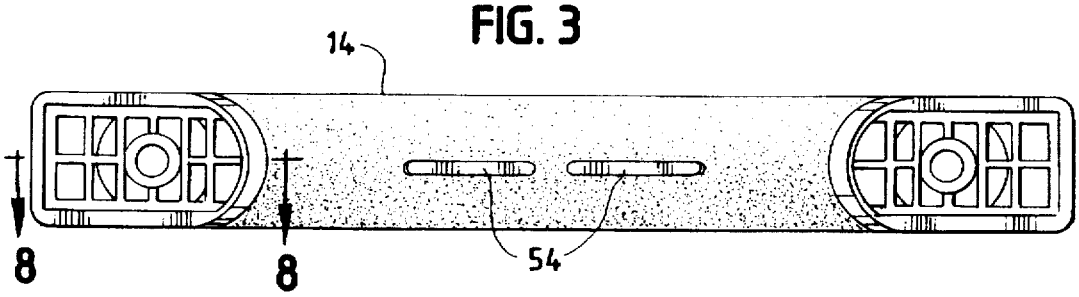
FIG. 3 is a bottom view of the handle of the float depicted in FIG. 1.

As shown in FIG. 5, islands 52 are integrally formed onto the outer surface of wall member 40, and are not covered by layer 21, as shown in FIG. 2. Islands 52 are oblong, and protrude a uniform distance from the outer surface of wall member 40. Islands 52 serve on an area in which to hold the components 22 firmly together in place when thermoplastic layer 21 is molded onto core 20. Similar islands 53 (FIG. 3) and 54 (FIG. 2) protrudes outwardly from the nose and grip portion edge 32, nose 24, as shown in FIG. 2.

Referring now to FIG. 7, two identical core components 22 are engaged to form core 20. When the identical core components are engaged, the lowermost edge surfaces 32 and uppermost edge surfaces 34 of the components 22 are contiguous and preferably flush with one another along their outer extent. The engagement surface 36 of one component 22 is directly contiguous with the engagement surface 38 of the other component 22. The edges of surfaces 36, 38 are flush when the components are engaged. The male bosses 48 of each component 22 engage the female recesses of the other component 22.

The engagement of the two core components 22 creates core 20, with flush transitions on the outer surface thereof along the lines of intersection of the two components 22. It will be appreciated that in engagement, the ribs 44, 46 of the two components 22 are contiguous for maximum compressive resistance. This symmetry is created by molding the core components 22 from the same or substantially identical, molds. It will be appreciated that creating only one mold increases productivity and decreases the costs associated with fabricating component 22.

Figure 8:
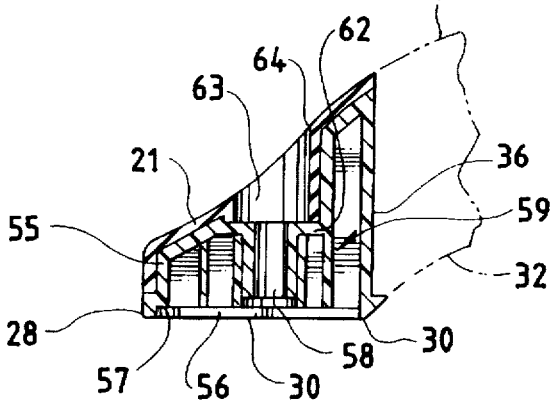
FIG. 8 is a cut-away view of a portion of the float handle taken along lines 8—8 in FIG. 3.

Referring now to FIGS. 5 and 8, each mounting nose 24 has a mounting ring 54 that provides flat bottom surface 30 which interfaces with one of the mounting surfaces 17 of blade 12. Mounting ring 54 is a closed loop that defines a recessed void 56 (FIG. 8). An inner ring surface 57 is ribbed in configuration (FIG. 5) being disposed in a plane space above the plane of bottom surface 30 and defining the vertical extent of recessed void 56.

Referring to FIG. 8, nose 24 is formed on outer wall member 55 and an internal ribbed structure 59. A cylinder 58 is secured in the internal ribbed structure extending upwardly from mounting void 56 and having its cylindrical axis disposed perpendicular to lower surface 30. Cylinder 58 defines a bore of a diameter that accepts mounting screw 18. The diameter is larger than the diameter of the threads of screw 18. The upper end of cylinder 58 is flared outwardly defining a mounting lip 62 which provides a lip surface 63 extending beyond the diameter of cylinder 58. Lip surface 63 serves as a seat for the head of mounting screw 18.

As screw 18 is tightened, lip 62 transfers the force of the screws to the rib structure 59 causing the cylinder 58 and its supporting rib structure 59 to flex to a relative small degree. Mounting void 56 facilitates the flexing. This flexing provides preload force which establishes an upward bias on the head of screws 18. The resulting bias maintains a tight engagement of mounting screw 18 with the threaded recesses in mounting surface 17 securing the screw in position. Additionally, this preload maintains constant contact between surface 30 and mounting surface 17 as the float is worked. This preload maintains a seal between surface 30 and surface 17 that prevents moisture or any other like material from violating the threads of the screw 18 or the threaded recesses of mounting surfaces 17.

A truncated cylinder 64 is secured in the internal ribbed structure 59 above cylinder 58. Cylinder 64 has a diameter larger than that of cylinder 58 and extends upwardly from lip 62. Screw 18 is received in cylinder 64 during assembly of the handle to the blade. Cylinder 64 is truncated along the outer curved surface of mounting nose 28.

Mounting ring 54 also flexes under the load provided by mounting screw 18 when it is fastened to blade 12. The flexing of mounting ring 54 further allows the mounting nose 28 to seal against mounting surface 17 when the two surfaces 30, 17 are engaged by the pressure applied by the tightening of mounting screw 18. This seal helps to form a moisture tight barrier between handle 14 and blade 12. The seal formed by these components allows the handle to give-and-take over the life of the tool.

As shown in FIGS. 5 and 8, lateral ribs 66 and longitudinal rib 68 extend upwardly from mounting void 56 to an outer wall member 55 of mounting nose 28. Lateral ribs 66 and longitudinal rib 68 are perpendicular to each other. Ribs 66 and 68 provide a support structure for the outer wall 60 of mounting nose 28, and distribute the load from mounting screw 18 to mounting ring 54.

The outer wall member 55, the ribs 66, 68 and cylinders 58, 64 are integrally molded together with core component 22 as one piece. Thermoplastic elastomer layer 21 is injection molded around core 20. The thermoplastic layer may be made out of any suitable material that is capable of providing a soft grippable surface for the handle, such as Santoprene TM elastomer. In the preferred embodiment, the material used to mold the core 20 is of the same base carrier resin as thermoplastic layer 21. This affords both a mechanical and thermal bond between core 20 and thermoplastic layer 21.

It is necessary to hold core 20 firmly in place during while thermoplastic layer 21 is applied around core 20. Core 20 may be held in place, at least in part, by applying forces to the islands 52 and 53 that protrude outwardly from the surface 40 of core 20. The necessary forces may be applied by the mold used to form thermoplastic layer 21. After thermoplastic layer 21 is molded around core 20, the outwardly presented surface of islands 52 are exposed and flush with thermoplastic layer 21.

Referring to FIG. 8, thermoplastic layer 21 extends downward to cover the inner wall of cylinder 64, and terminates at lip 62. Extending thermoplastic layer 21 along the walls of cylinder 64 decreases the likelihood that thermoplastic layer 21 will snag or shear over the life of the tool.

Figure 9:
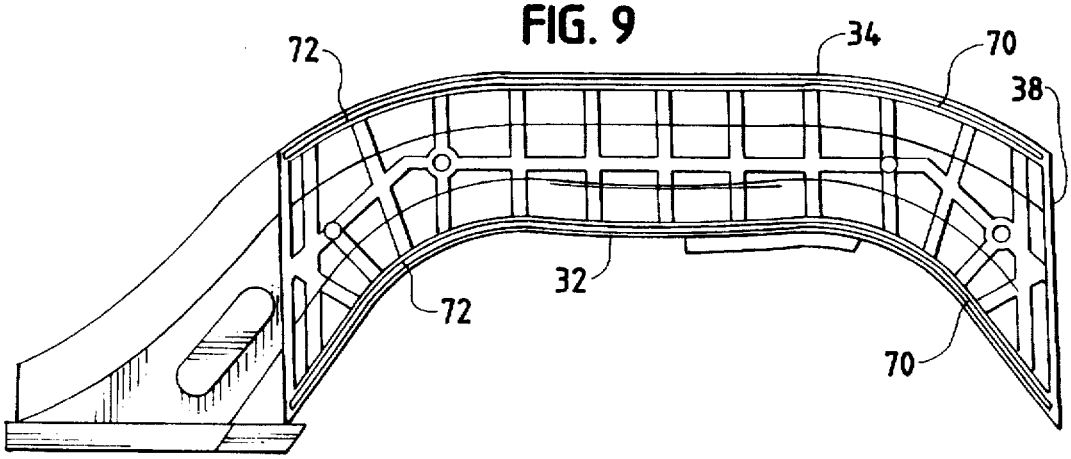
FIG. 9 is a side view of the core component of FIG. 4 having tongue and groove engagement surfaces.

Referring to FIG. 9, in the preferred embodiment of the present invention, a tongue 70 and groove 72 arrangement is provided along edges 32 and 34. Grooves 72 extend along edges 32 and 34 to the mid-point of half grip portion 26. Tongues 72 extend from the mid-point of half grip portion 26 to the intersection of plane 38 edges 32 and 34. When two core components 22 are engaged, the tongues 70 of one core component engage the grooves 72 of the other core component 22 and vice versa.

While only one preferred embodiment of the invention has been discussed above, those of ordinary skill in the art will recognize and appreciate that this embodiment may be modified and altered without departing from the central spirit and scope of the invention. Thus, the preferred embodiments described above is to be considered in all respects as illustrative and not restrictive, the scope of the invention being indicated by the appended claims, rather than by the foregoing description, and all changes which come within the meaning and range of equivalency of the claims are intended to be embraced herein.

What is claimed is:

1. A concrete float handle, comprising:

an inner core and an outer core; said inner core formed from two identical core components, each of said core components including;

i) a mounting nose located at one end of a said component, said nose including, (a) a first outer surface; and (b) a mounting surface located at the bottom of said mounting nose; and ii) a hand grip portion extending from said mounting nose and defining the other end of said core component, said hand grip portion, including;

(a) a second outer surface; and (b) an engagement edge surface; and said outer core being molded from a rubber-like thermoplastic material, said outer core covering a portion of said inner core to provide an outer grip surfaces;

said outer core being molded such that a mechanical and thermal bond is formed between said inner core components and said outer core.

2. A concrete float handle according to claim 1 wherein said nose further includes a mounting ring carrying said mounting surface.

3. A concrete float handle according to claim 1, wherein said core components have a plurality of islands protruding outwardly from said core components.

4. A concrete float handle according to claim 3, wherein said islands extend substantially flush and contiguous to an outer surface of said outer core.

5. A concrete float handle according to claim 11, wherein said engagement edge surfaces include engagement surfaces shaped for engaging said core components.

6. A concrete float handle according to claim 5, wherein said engagement surfaces comprise a tongue and groove.

7. A concrete float handle according to claim wherein said core components include an outer wall; and an internal support means for internally supporting said outer wall.

8. A concrete float handle according to claim 7 wherein said internal support means includes a ribbed shaped structure.

9. A concrete float handle, comprising:

an inner core and an outer core; said inner core formed from two identical core components, each of said core components including;

i) a mounting nose located at one end of a said component, said nose including, (a) a first outer surface;

(b) a mounting surface located at the bottom of said mounting nose;

(c) a screw receiving cavity having an entrance and an exit; and ii) a hand grip portion extending from said mounting nose and defining the other end of said core component, said hand grip portion, including;

(a) a second outer surface; and (b) an engagement edge surface; and said outer core being molded from a rubber-like thermoplastic material, said outer core covering a portion of said inner core to provide an outer grip surface.

* * * * *

UNITED STATES PATENT AND TRADEMARK OFFICE

CERTIFICATE OF CORRECTION

PATENT NO. : 5,781,956

DATED : July 21, 1998

INVENTOR(S) : Kelsay et al.

It is certified that error appears in the above-identified patent and that said Letters Patent is hereby corrected as shown below:

At Col. 4, line 55, delete "mounting nose 28" and substitute therefor --mounting nose 24--.

At Col. 4, line 59, delete "nose 28" and substitute therefor --nose 24--.

At Col. 4, line 67, delete "mounting nose 28" and substitute therefor --mounting nose 24--.

At Col. 5, line 3, delete "mounting nose 28" and substitute therefor --mounting nose 24--.

At Col. 6, line 25, delete "claim 11" and substitute therefor --claim 1--.

At Col. 6, line 30, delete "claim wherein" and substitute therefor --claim 1, wherein--.

Signed and Sealed this

Twenty-fifth Day of January, 2000

*Attest:*

*Attesting Officer*

*Acting Commissioner of Patents and Trademarks*